US006666006B2

(12) United States Patent
Kuchler

(10) Patent No.: US 6,666,006 B2
(45) Date of Patent: Dec. 23, 2003

(54) SHEET FEEDER AND SEALER FOR AUTOMATIC SLICING MACHINE

(76) Inventor: Fritz Kuchler, Klatteweg 4-6, A-9010 Klagenfurt (AT)

( * ) Notice: Subject to any disclaimer, the term of this patent is extended or adjusted under 35 U.S.C. 154(b) by 0 days.

(21) Appl. No.: 10/151,707

(22) Filed: May 20, 2002

(65) Prior Publication Data

US 2002/0170277 A1 Nov. 21, 2002

(30) Foreign Application Priority Data

May 18, 2001 (AT) ..... A793/2001
Apr. 25, 2002 (EP) ..... 02100418

(51) Int. Cl.[7] ..... B65B 63/00

(52) U.S. Cl. ..... 53/514; 53/517; 53/206; 53/389.3; 83/155.1

(58) Field of Search ..... 53/514, 517, 518, 53/540, 206, 556, 389.1, 389.3, 389.4; 83/77, 88, 153, 167, 155.1

(56) References Cited

U.S. PATENT DOCUMENTS 1,340,219 A * 5/1920 Folk ..... 83/153
3,834,259 A * 9/1974 Kuchler ..... 83/88
4,035,985 A * 7/1977 Aoyama et al. ..... 53/463
4,065,911 A * 1/1978 Fagan ..... 53/502
4,185,527 A * 1/1980 Kuchler ..... 83/88
4,213,284 A * 7/1980 Silverman et al. ..... 53/74
4,541,225 A * 9/1985 Byland ..... 53/556
4,580,475 A * 4/1986 Antonissen ..... 83/77
4,794,996 A * 1/1989 Wallace et al. ..... 83/77
5,509,253 A * 4/1996 Cappi et al. ..... 53/556
5,918,444 A * 7/1999 Kuchler ..... 53/517
6,279,302 B1 8/2001 Kuchler

FOREIGN PATENT DOCUMENTS

| | | |
|---|---|---|
| CH | 623264 | 5/1981 |
| EP | 0849177 | 6/1988 |
| EP | 06727587 | 9/1995 |

* cited by examiner

*Primary Examiner*—John Sipos
*Assistant Examiner*—Louis Huynh
(74) *Attorney, Agent, or Firm*—Herbert Dubno; Andrew Wilford

(57) ABSTRACT

A slicing machine has a main housing having a horizontal conveyor surface and a subassembly in the main housing for cutting slices from a foodstuff and depositing them on the conveyor surface. A supply housing immediately upstream of the main housing carries a supply roll of flexible strip and mechanism for feeding the flexible strip downstream toward the main housing. A cutter on the supply housing can sever a sheet from a leading end of the flexible strip. A gripper above the surface is displaceable between an upstream and downstream positions of the surface. The gripper is closable to grip and openable to release the leading end of the flexible strip so as it moves into its downstream positions it pulls the strip downstream above the surface and, once the cutter has operated, the gripper opens to drop the sheet severed from the strip down onto the surface.

10 Claims, 5 Drawing Sheets

SHEET FEEDER AND SEALER FOR AUTOMATIC SLICING MACHINE

FIELD OF THE INVENTION

The present invention relates to an automatic slicing machine. More particularly this invention concerns such a machine which is equipped to wrap and seal the slices.

BACKGROUND OF THE INVENTION

A standard slicing machine has an input table that can be reciprocated longitudinally past a normally circular rotating blade to cut slices from a foodstuff, for instance a piece of meat or cheese, sitting on the input table. On the other side of the blade the slices are picked up by a conveyor, typically a fork-, belt-, or chain-type arrangement having a vertical support plate and provided with a multiplicity of sharp points so that the slices can be caught on the conveyor as they issue from the downstream side of the blade. A transfer fork has tines engaged between adjacent elements of the conveyor and can be pivoted to pull the slices off the conveyor and deposit them on an output table which is positioned horizontal underneath the downstream side of the blade. Thus as the input table is moved back and forth, slices are cut from the foodstuff thereon, these slices pass the blade and are picked up the conveyor, and the transfer fork deposits them in a stack on the output table. Such machines are described in detail in my earlier U.S. Pat. Nos. 4,185,527, 4,217,650, 4,338,836, 4,379,416, 4,586,409, 4,598,618, 4,763,738, and 4,867,257.

In order to separate the slices from each other, to separate groups of slices, and/or to form a package around the slices, it is known to insert underneath the stack, between the slices, and/or on top of the stack a sheet or foil. In one system a sheet is set on the conveyor before the stack is started so that the stack is formed atop this bottom sheet, then sheets are interposed between succeeding slices as they are deposited on the bottom sheet and on each other or are interposed after a certain number of slices corresponding to a standard portion has been deposited. A top sheet is deposited on top of the stack when the desired number of slices have been deposited.

The standard system for doing this has a supply, normally a roll, of the flexible strip from which the sheets are cut and a feeder that is typically a pair of pinch rollers that can be driven to pull the flexible strip from the roll. The end of the roll is pushed by the rollers out onto a flat table and a cutter slices off the end. Then a separate manipulator normally having a plurality of suction grippers picks the sheet formed by the cut-off end and deposits it on the conveyor where the foodstuff slices are stacked.

In commonly owned U.S. Pat. No. 6,279,302 a slicing machine that deposits foodstuff slices in a stack atop a support in a stacking station has a sheet-interposing device provided with a supply roll of flexible strip and a feed roller for feeding a leading end of the flexible strip in a direction to the stacking station. A guide between the station and the roller imparts to the sheet leading end an upwardly concave U-shape to stiffen the sheet leading end so it projects horizontally stiffly from the guide above the station. A cutter movable between the guide and the station cuts off the sheet leading end so that the cut-off end drops down in the station.

Thus the equipment can comprise, normally arrayed in a row or line, an upstream paper roll and feeder, a central slicing and arraying machine, and a downstream sealing machine. In many markets this equipment is intentionally set up so the customers can watch it work, assuring themselves at the same time that they are getting what they want, and that the foodstuff is being handled by the machine in a hygienic manner. All the operator needs to do is load in the piece of meat, wurst, cheese, or the like to be sliced, set the desired slice thickness, total weight, and array type, and the machine creates a sealed package for the customer. The machine is even known to be modular, so that the supply and sealing units can be taken off the slicing/arraying unit. As a result such machines are quite large.

OBJECTS OF THE INVENTION

It is therefore an object of the present invention to provide an improved automatic slicing and packaging machine.

Another object is the provision of such an improved automatic slicing and packaging machine which overcomes the above-given disadvantages, that is which can produce a sealed package but that is of a relatively small footprint.

SUMMARY OF THE INVENTION

A slicing machine has according to the invention a main housing having a horizontal conveyor surface and a subassembly in the main housing for cutting slices from a foodstuff and depositing them on the conveyor surface. A supply housing immediately upstream of the main housing carries a supply roll of flexible strip and mechanism for feeding the flexible strip downstream toward the main housing. A cutter on the supply housing can sever a sheet from a leading end of the flexible strip. In accordance with the invention a gripper above the surface is displaceable between an upstream position generally at the cutter and a downstream position downstream of the surface. The gripper is closable to grip the leading end of the flexible strip and openable to release it. A controller connected to the gripper, to the cutter, and to the supply periodically displaces the gripper between its upstream and downstream positions so as to pull the strip downstream above the surface, operates the cutter to sever a sheet from the downstream strip end generally when the gripper reaches its downstream position, and opens the gripper in the downstream position to drop the sheet severed from the strip down onto the surface.

Thus with this system the supply housing carries the roll of flexible strip as well as the mechanism for feeding it and the cutter. These elements are mounted on a separate housing that fits right against the main housing having the cutting/arraying subassemblies so that the entire machine according to the invention is relatively compact.

In accordance with the invention the supply housing and main housing are provided with interfitting formations that hang the supply housing on the main housing. Thus the supply housing can be unhooked and taken away when the main housing and its elements need cleaning, which is particularly advantageous since the supply housing never touches the food stuff and stays quite clean.

Furthermore, a drive on the main housing includes a drive wheel exposed at an upstream end of the main housing, a drive wheel exposed at a downstream end of the supply housing, engaging the main-housing drive wheel, feed rollers on the supply housing engaging the flexible strip, and a transmission connecting the supply-housing drive wheel with the feed rollers and with the gripper for synchronous movement. Thus when the supply housing is hung on the main housing, the mechanical connection is made to the supply mechanism, eliminating the need for a separate drive for this part. The cutter on the other hand includes an electrically powered actuator and electrical contacts connected to the actuator and exposed on a downstream end of the supply housing. Control contacts on an upstream end of the main housing engage the supply-housing contacts when the supply housing is hung on the main housing to supply low voltage to the actuator, normally a solenoid, to operate it.

The gripper according to the invention has a pair of relatively movable jaws oppositely engageable with the flexible strip. A spring urges them together and cams are effective to spread them to grasp and release the leading end of the flexible strip.

According to the invention a sealer housing is provided immediately downstream of the main housing, elements in the sealer housing seal sheets of the flexible strip around slices produced by the cutter. A conveyor on the main housing forms the surface, and a drive motor in the sealer housing is connected to the conveyor in the main housing. In this system the controller is in the main housing. The connection is made by contacts like for the actuator of the cutter.

The sealer in accordance with the invention further includes a short conveyor forming an extension of the conveyor surface of the main housing, an upper heated annular die above the short conveyor, and an actuator controlled by the controller for raising the short conveyor and a slice stack thereon up into engagement with the die to fuse sheets underneath and on top of the stack together. Thus the system has on a separate housing, which also never directly contacts the foodstuff being packaged, all the parts for sealing the package made up on the middle main housing.

According to the invention a smoothing element connected to and movable upstream and downstream with the gripper is engageable downwardly with slices on the conveyor surface. A cam on the main housing raises the smoothing element as the gripper travels from the upstream to the downstream position and lowers it when moving from the downstream to the upstream position. A two-arm lever pivoted on the gripper has one arm carrying the smoothing element and another arm engageable with the cam. A spring urges the other arm into engagement with the cam.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
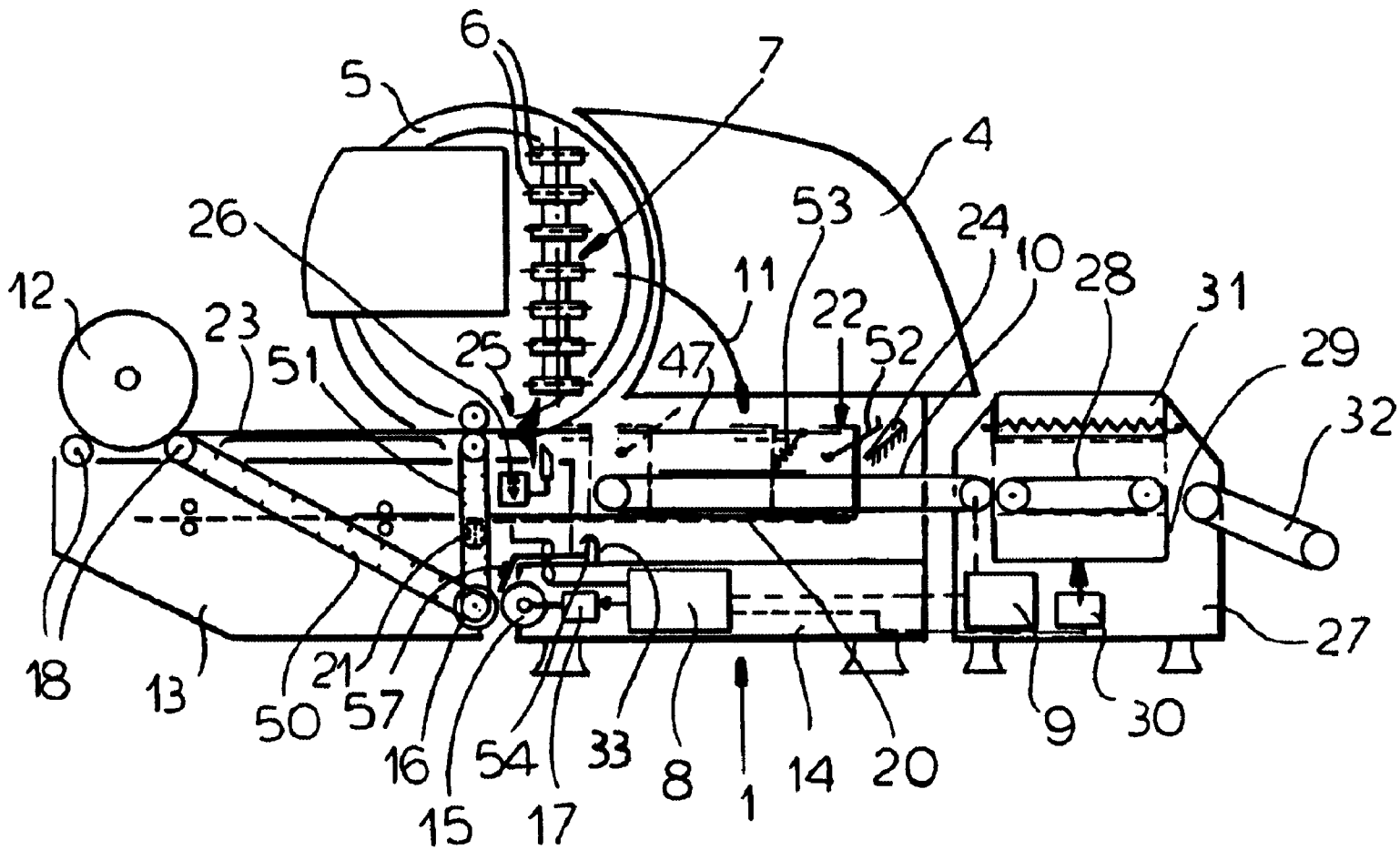
FIG. 1 is a partly diagrammatic small-scale sectional side view of the machine according to the invention.
Figure 2:
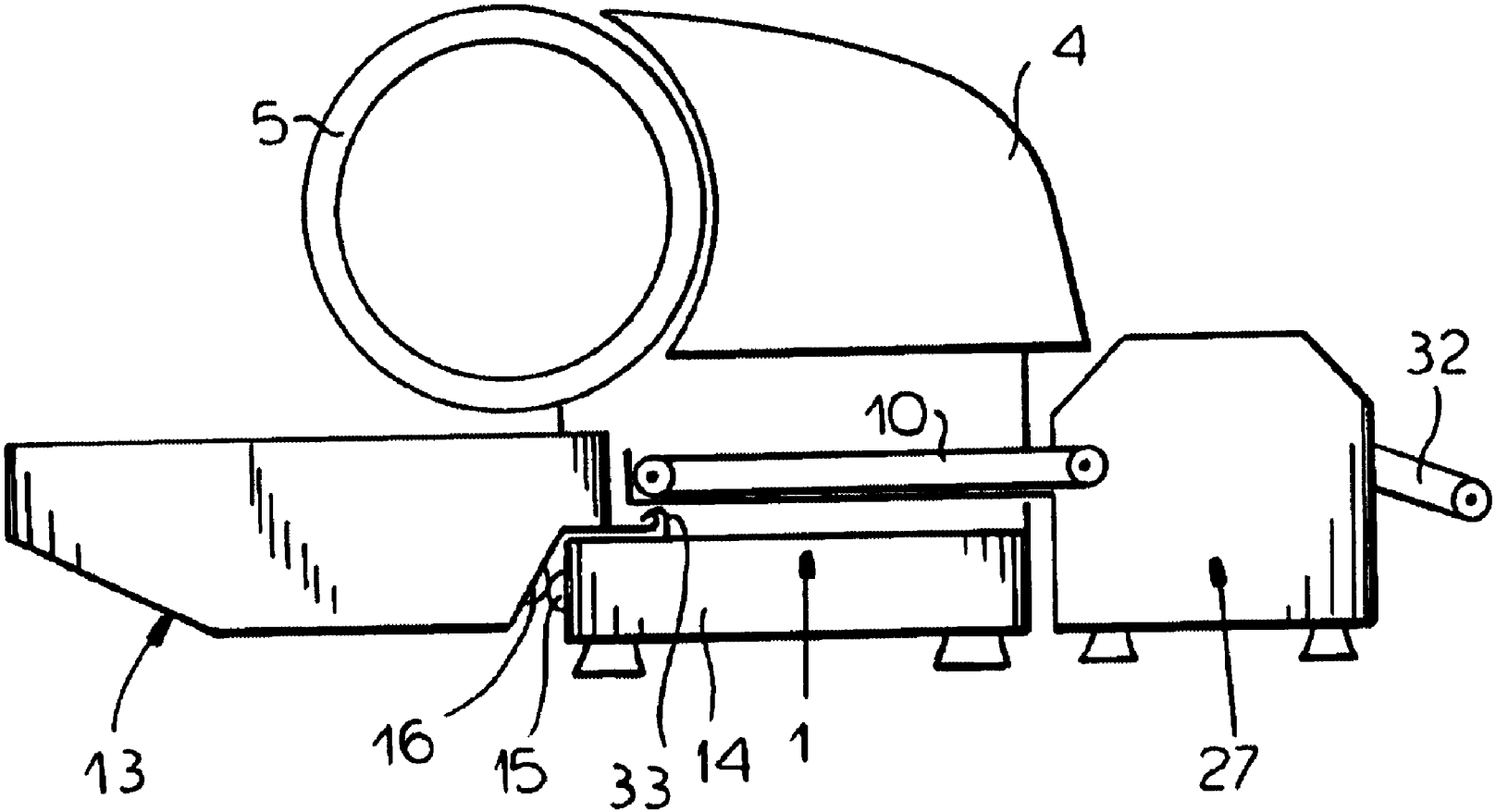
FIG. 2 is a side view of the machine.
Figure 3:
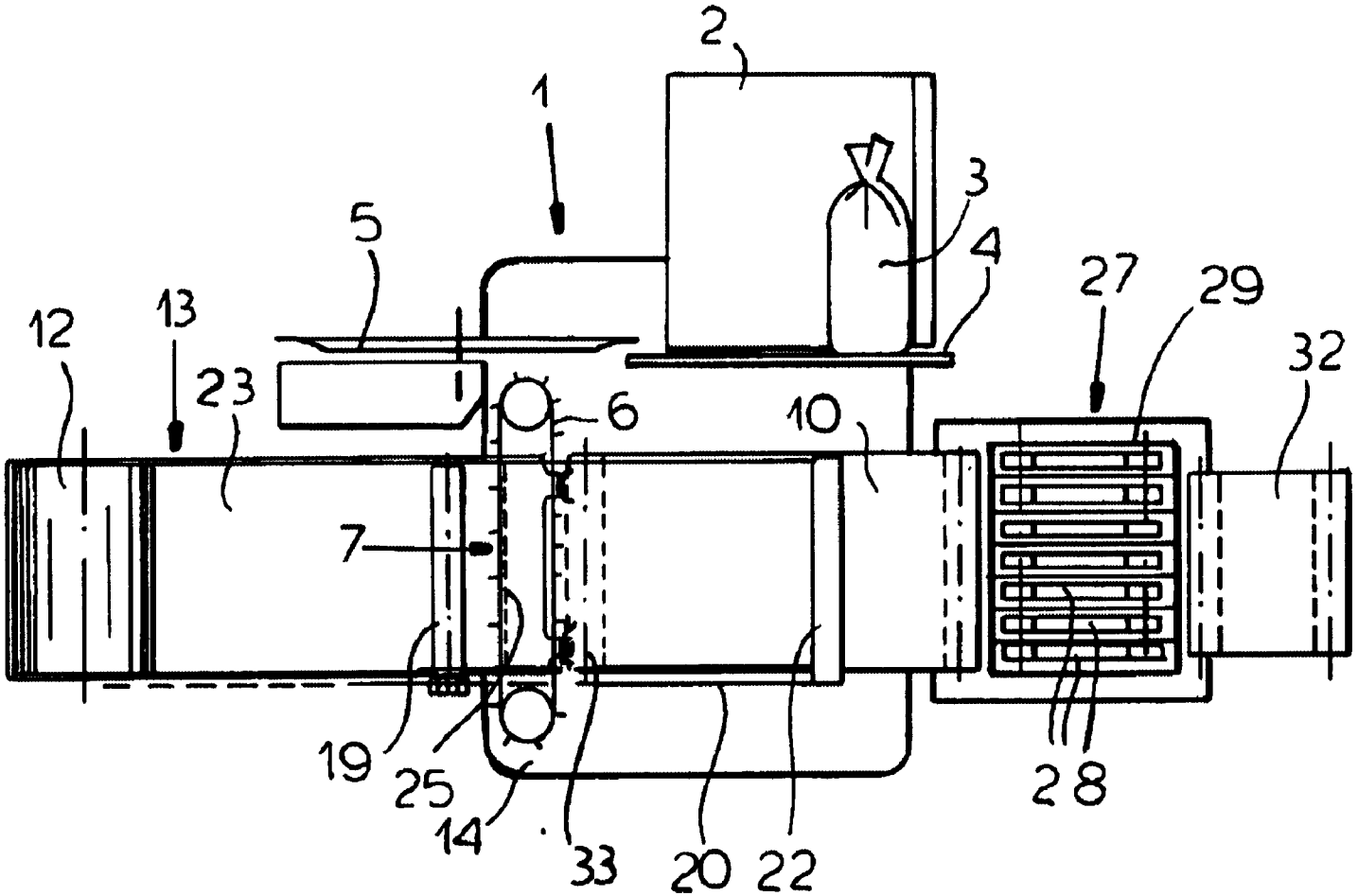
FIG. 3 is a top view of the machine.

As seen in FIGS. 1 through 3 a slicing/packaging machine 1 according to the invention has a main housing 14 flanked on its upstream side by a feeder housing 13 and on its downstream side by a sealer housing 27. An upwardly projecting lip 54 on the housing 13 allows it to be hung in a downwardly open slot 33 of the housing 14 while the housing 27 normally stands adjacent this housing 14.

The main housing 14 carries a slide or carriage 2 adapted to hold a foodstuff 3, here a wurst, which is pressed against a stationary abutment plate 4 and moved past a standard circularly planar blade 5 to cut slices 46 (FIGS. 4–8) from it. Point-carrying feeder chains 6 carried on a frame 7 moved by a controller 8 deposit the slices as shown by arrow 11 on a horizontal deposition/conveyor surface formed by a belt 10 also operated by the controller 8, the slices dropping into an array which may be a simple stack or extended in two directions depending on how the controller 8 moves the belt 10. The above-cited patents describe systems for controlling the array the slices are deposited in.

The supply housing 13 carries a roll 12 of a flexible strip 23, normally plastic or plastic-coated paper, on a pair of rollers 18 at least one of which is driven by a belt 50 from a gear 16 projecting downstream (to the right in FIGS. 1–3) from the housing 13 and meshing with a gear 15 projecting upstream from the housing 14 and driven by a motor 17 operated by the controller 8. The strip 23 issuing from the roll 12 moves downstream and through a pair of pinch rollers 19 driven by a belt 51 from the drive gear 16. In addition the housing 13 carries a standard two-blade cutter 25 immediately downstream of the pinch rollers 10. The cutter 25 is closed by a solenoid 26 operated by the controller 8 and can sever a sheet 47 off the downstream end of the strip 23 as will be described below. Contacts 57 on the housings 13 and 14 bear against each other with spring force to supply voltage to the solenoid 26 when the housing 13 is hung on the housing 14 by the formations 33 and 54.

The main housing 14 carries a gripper or feeder bar 20 formed as a rack meshing with a gear 21 driven by the belt 51 and having a fixed jaw 22 and a movable jaw 52 both movable horizontally level with the strip 23 coming off the supply roll 12. A spring 53 normally holds the jaws 22 and 52 together, but, when the rack bar 20 is in a fully downstream position as illustrated in FIG. 1, the jaw 52 engages a fixed abutment 24 and is pivoted away from the jaw 22. Another such abutment is provided to open and then close the jaws 22 and 52 as they move into an upstream end position (dashed lines in FIG. 1) of the feeder bar 20.

The sealer housing 27 has a belt 28 carried on a frame 29 raisable by an actuator 30 and a motor 9 that connects to the downstream end of the conveyor 10 and that is in turn operated by the controller 8. Above the belt 28 is an annular electrically heated welding frame or die 31 which, when pressed around a stack of slices sitting on a weldable sheet and covered by a weldable sheet, can weld the sheets together to seal in the slice stack as described below. An unloading conveyor 32 leads down and away from the conveyor 28 in its lower illustrated position.

The above-described machine 1 works as follows:

A foodstuff 3 is set on the table 2 and the machine 1 is set for the desired slice thickness, package weight, and slice array. At this time the feeder bar 20 is all the way to the left, that is in its most upstream position, and its jaws 22 and 52 are gripping the leading edge of the flexible strip 23.

At first the drive 17 is operated by the controller 8 to simultaneously rotate the supply roller 12, turn the pinch rollers 19, and retract the bar 20 downstream so as to pull the flexible strip 23 straight downstream from the supply roll 12. The peripheral speeds of the rollers 18 and 1 are identical to the linear displacement speed of the bar 20 to keep the strip 23 taut. Once the bar 20 comes to the solid-line downstream position, the abutment 24 opens the jaws 22 and 52 and the controller 8 cycles the cutter 25 to cut a sheet 47 from the leading end of the material 23. This severed and released sheet 47 will drop down onto the support belt 10.

Then the controller 8, as is well known in the art, reciprocates the table 2 past the blade 5 and operates the stacking belts 6 to form a stack or array of slices 46 (FIG. 4) atop the sheet 47. This array can be a simple stack of superpositioned slices or can be a row of offset slices or even a two-dimensional, e.g. spiral, array. During this slicing and arraying operation the jaws 22 and 52 stay in their downstream position and the rollers 18 and 19 are stationary.

Once the desired number of slices 46 has been dropped atop the bottom sheet 47, the drive 17 advances the strip 23 somewhat so it projects past the cutter 25 and the bar 20 is advanced back upstream (to the left in FIG. 1) and its jaws 22 and 52 are opened and closed on the projecting leading end of the strip 23. Then the drive 17 is operated to pull another section of the material 23 out and cut off another sheet 48 that is dropped atop the stack as described above at the start of operation. The gear 16 is connected to the rollers 18 and 19 via unillustrated one-way clutches, so that when the gear 15 is reversed the bar 20 is pulled back, but the strip 23 is not wound back up on the roll 12.

This stack of slices 46 sandwiched between two sheets 47 and 48 is then displaced downstream by the conveyor 10 and onto the synchronously moving conveyor 28 that runs until the stack is exactly centered under the sealing die 31. The actuator 30 then lifts the frame 29 to press the edges of the two sheets 47 and 48 together, thereby sealing in the stack.

Thereafter the frame 29 is dropped back down to the illustrated lower position and the two belt conveyors 28 and 32 are operated to carry off the sealed product.

FIGS. 4 through 8 show a system for smoothing a top sheet 48 over a stack of slices 46. One or more soft rollers 40 are pivoted about a horizontal axis 41 on one arm of a two arm lever 42 whose other arm carries a roller 43 urged by a spring 44 down against a cam 45. This arm 42 is itself pivoted on an upstream side of the bar 20 carrying the gripper jaws 22 and 52.

Figure 5:
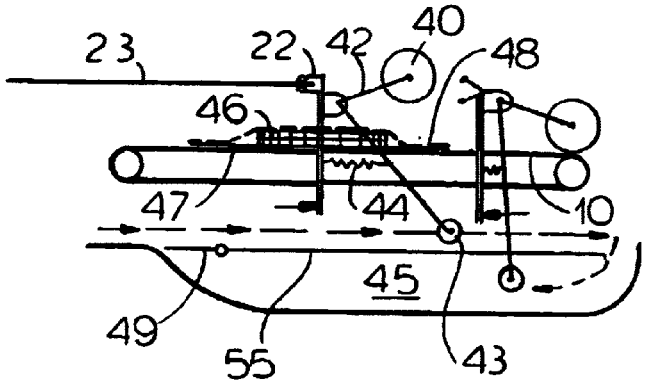
Figure 6:
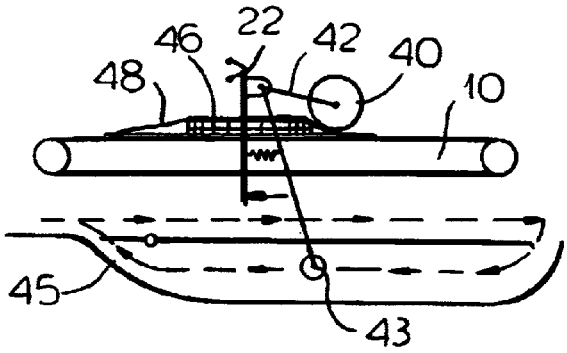
Figure 7:
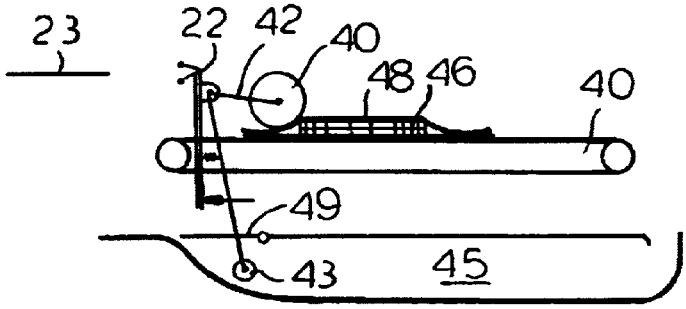

The cam 45 comprises a stationary upper part 55, an upwardly arcuate lower part 56, and an upwardly pivotal flap 49 normally closing a gap at an upstream end of the part 55, a similar gap at the downstream end always being open. Thus as the bar 20 moves the lever 42 downstream, the roller 43 will initially as shown in FIG. 5 ride atop the parts 49 and 55, holding the smoothing rollers 40 up and out of contact with the package on the conveyor 10. Once, however, the roller 43 drops off the end of the part 55 as shown to the right in FIG. 5, the lever 42 pivots down and, as the lever 42 is moved back upstream as shown in FIGS. 6 and 7, the rollers 40 ride on the package and flatten and smooth out the top sheet 48, eliminating any bubbles from it and largely squeezing the air out of the package.

Figure 4:
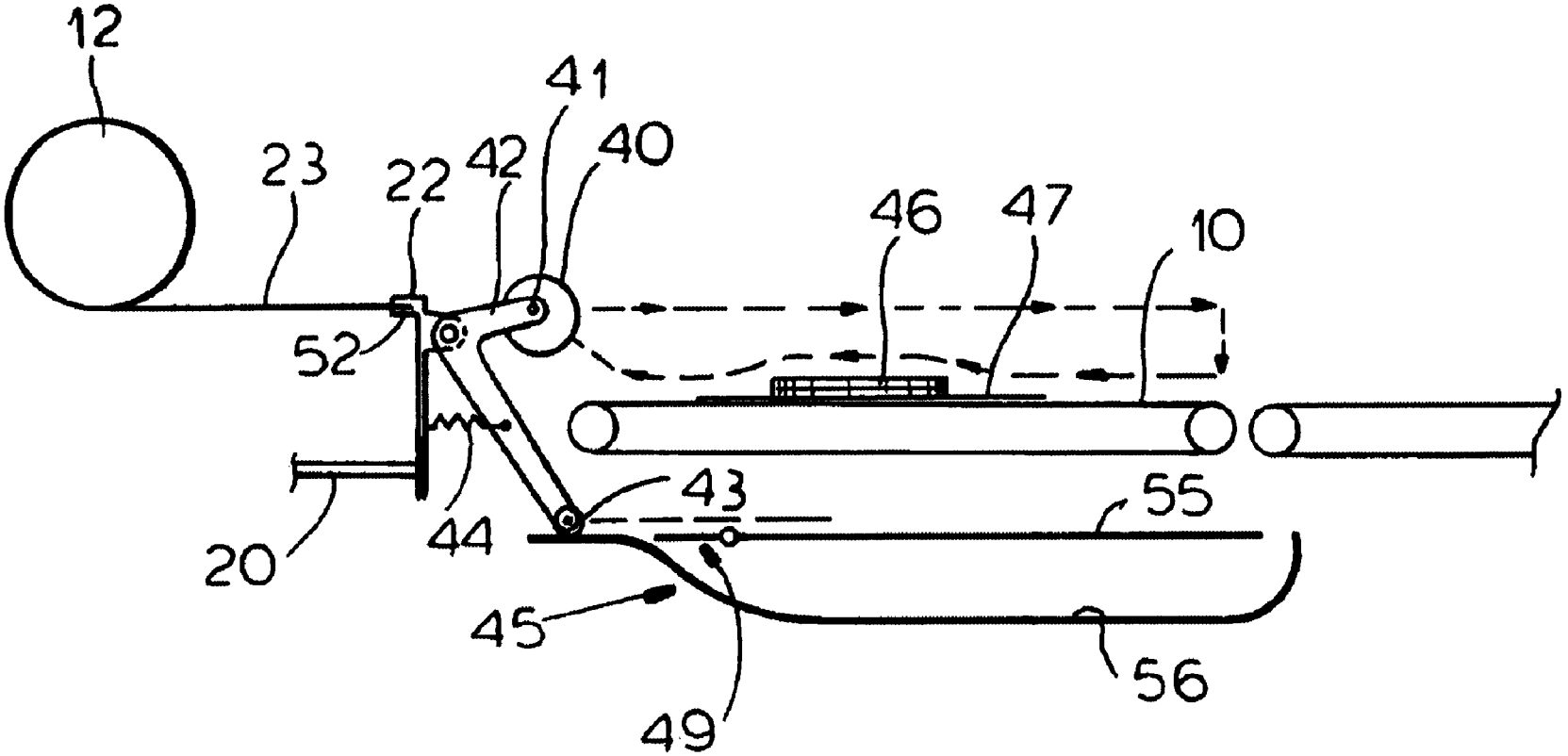
FIGS. 4 through 8 are largely diagrammatic side views illustrating a system for smoothing the cover sheet.
Figure 8:
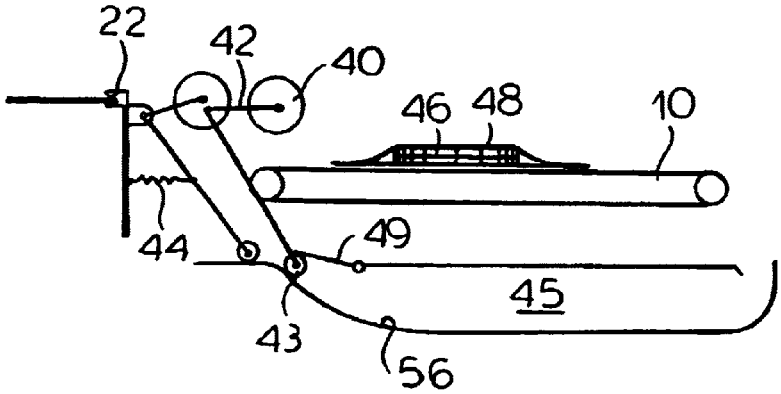

Once the roller 43 comes to the upstream end of the lower part 56 of the cam 45 as shown in FIG. 8 it rises up, thereby lifting the rollers 40 and coming out past the flap 49 so that it returns to the position of FIG. 4. Since the rollers 40 only contact the top sheet 48, they will remain clean.

I claim:

1. A slicing machine comprising:

a main housing having a horizontal surface;

means in the main housing for cutting slices from a foodstuff and depositing them on the surface;

a supply housing immediately upstream of the main housing;

supply means on the supply housing holding a supply roll of flexible strip for feeding the flexible strip downstream toward the main housing;

cutting means on the supply housing for severing a sheet from a leading end of the flexible strip;

a pair of gripper jaws above the surface jointly displaceable parallel to the surface between an upstream position generally at the cutting means and a downstream position downstream of the slices on the surface, the gripper jaws being closable to grip the leading end of the flexible strip and openable to release it; and control means connected to the gripper jaws, to the cutting means, and to the supply means for periodically displacing the gripper jaws between it's the upstream and downstream positions so as to pull the strip downstream above the surface, for operating the cutting means to sever a sheet from the downstream strip end generally when the gripper jaws reach the downstream position, and for opening the gripper jaws in the downstream position to drop the sheet severed from the strip down onto the surface.

2. The slicing machine defined in claim 1 wherein the supply housing and main housing are provided with interfitting formations that hang the supply housing on the main housing.

3. The slicing machine defined in claim 2, further comprising:

a drive on the main housing including a drive wheel exposed at an upstream end of the main housing;

a drive wheel exposed at a downstream end of the supply housing, engaging the main-housing drive wheel;

feed rollers on the supply housing engaging the flexible a strip; and means connecting the supply-housing drive wheel with the feed rollers and with the gripper jaws for synchronous movement.

4. The slicing machine defined in claim 2 wherein the cutting means includes an electrically powered actuator and electrical contacts connected to the actuator and exposed on a downstream end of the supply housing, the control means including contacts on an upstream end of the main housing engaging the supply-housing contacts when the supply housing is hung on the main housing.

5. The slicing machine defined in claim 1, further comprising:

a sealer housing immediately downstream of the main housing;

sealing means in the sealer housing for sealing sheets of the flexible strip around slices produced by the cutting means;

a conveyor on the main housing forming the surface;

a drive motor in the sealer housing connected to the conveyor in the main housing.

6. The slicing machine defined in claim 5 wherein the control means is in the main housing.

7. The slicing machine defined in claim 5 wherein the sealing means includes:

a short conveyor forming an extension of the surface of the main housing;

an upper heated annular die above the short conveyor; and actuator means controlled by the control means for raising the short conveyor and a slice stack thereon up into engagement with the die to fuse sheets underneath and on top of the stack together.

8. The slicing machine defined in claim 1, further comprising a smoothing element connected with the gripper jaws for joint upstream and downstream movement therewith and biased downwardly toward the surface.

9. A slicing machine comprising:

a main housing having a horizontal surface;

means in the main housing for cutting slices from a foodstuff and depositing them on the surface;

a supply housing immediately upstream of the main housing;

supply means on the supply housing holding a supply roll of flexible strip for feeding the flexible strip downstream toward the main housing;

cutting means on the supply housing for severing a sheet from a leading end of the flexible strip;

a gripper above the surface displaceable between an upstream position generally at the cutting means and a downstream position downstream of the surface, the gripper being closable to grip the leading end of the flexible strip and openable to release it;

control means connected to the gripper laws, to the cutting means, and to the supply means for periodically displacing the gripper between its upstream and downstream positions so as to pull the strip downstream above the surface, for operating the cutting means to sever a sheet from the downstream strip end generally when the gripper reaches its downstream position, and for opening the gripper in the downstream position to drop the sheet severed from the strip down onto the surface;

a smoothing element connected with the gripper for joint upstream and downstream movement therewith and biased downwardly toward the surface; and cam means on the main housing for raising the smoothing element as the gripper travels from the upstream to the downstream position and for lowering the smoothing element when moving from the downstream to the upstream position.

10. The slicing machine defined in claim 9, further comprising a two-arm lever pivoted on the gripper and having one arm carrying the smoothing element and another arm engageable with the cam means; and a spring urging the other arm into engagement with the cam means.

* * * * *